US012108918B2

(12) United States Patent
Barber, Jr.

(10) Patent No.: US 12,108,918 B2
(45) Date of Patent: Oct. 8, 2024

(54) PORTABLE SCRUBBING ASSEMBLY

(71) Applicant: Ralph Barber, Jr., Atlanta, GA (US)

(72) Inventor: Ralph Barber, Jr., Atlanta, GA (US)

( * ) Notice: Subject to any disclaimer, the term of this patent is extended or adjusted under 35 U.S.C. 154(b) by 604 days.

(21) Appl. No.: 17/411,830

(22) Filed: Aug. 25, 2021

(65) Prior Publication Data

US 2022/0061598 A1 Mar. 3, 2022

Related U.S. Application Data

(60) Provisional application No. 63/073,728, filed on Sep. 2, 2020.

(51) Int. Cl.
*A47K 7/02* (2006.01)

(52) U.S. Cl.
CPC ..... *A47K 7/028* (2013.01)

(58) Field of Classification Search
CPC ..... Y10T 403/7117; Y10T 403/7129; Y10T 403/7141; A47K 7/00; A47K 7/022; A47K 7/028
USPC ..... 15/144.4; 403/387, 389, 391
See application file for complete search history.

(56) References Cited

U.S. PATENT DOCUMENTS

| | | | | |
|---|---|---|---|---|
| 6,754,929 | B2 | 6/2004 | Fichter | |
| 6,823,555 | B2 | 11/2004 | Warren | |
| 8,967,898 | B1 * | 3/2015 | Dayeh | A47K 7/03 401/23 |
| 9,370,282 | B1 | 6/2016 | Petersen | |
| 2010/0011525 | A1 * | 1/2010 | Habrle | A46B 5/0033 15/114 |
| 2017/0238769 | A1 * | 8/2017 | Van Varick | B25G 1/02 |
| 2019/0110647 | A1 * | 4/2019 | Kolonne | A46B 5/005 |
| 2020/0154954 | A1 | 5/2020 | Mesue | |

* cited by examiner

*Primary Examiner* — Katina N. Henson

(57) ABSTRACT

A portable scrubbing assembly for scrubbing a user's body includes a plurality of scrubbing plates that each has a pair of engaging rods integrated into the scrubbing plates. A plurality of scrubbers is provided and a respective one of the scrubbers is attached to a respective one of the scrubbing plates to scrub a user's body. A handle plate includes a pair of engagement channels which releasably engages a respective one of the engagement rods on a respective scrubbing plate for releasably attaching the respective scrubbing plate to the handle plate. A handle is disposed on the handle plate to facilitate the user to employ the scrubber that is attached to the scrubber plate for scrubbing the user's body.

9 Claims, 9 Drawing Sheets

PORTABLE SCRUBBING ASSEMBLY

(b) CROSS-REFERENCE TO RELATED APPLICATIONS

I hereby claim the benefit under 35 U.S.C. Section 119(e) of U.S. Provisional application No. 63/073,728 filed Sep. 2, 2020

(c) STATEMENT REGARDING FEDERALLY SPONSORED RESEARCH OR DEVELOPMENT

Not Applicable

(d) THE NAMES OF THE PARTIES TO A JOINT RESEARCH AGREEMENT

Not Applicable

(e) INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

(f) STATEMENT REGARDING PRIOR DISCLOSURES BY THE INVENTOR OR JOINT INVENTOR

Not Applicable

(g) BACKGROUND OF THE INVENTION

(1) Field of the Invention

The disclosure relates to scrubbing devices and more particularly pertains to a new scrubbing device for scrubbing a user's body. The device includes a plurality of scrubbing plates that each includes a pair of engaging rods and a plurality of scrubbers that is attached to a respective one of the scrubbing plates. The device includes a handle plate which has a pair of engaging channels that each receives a respective engaging rod on a respective scrubbing plate. The device further includes a handle that is integrated into the handle plate which can be gripped to facilitate a user to scrub their body with the scrubber that is attached to the handle plate.

(2) Description of Related Art Including Information Disclosed Under 37 CFR 1.97 and 1.98

The prior art relates to scrubbing devices including a variety of personal hygiene devices that each includes a brush head which can be attached to a handle. In several instances the handle is hollow for storing a liquid soap which can be released through the brush head. The prior art discloses a personal cleaning device that includes a sponge, or loofah, which is attached to a handle for scrubbing a user's body.

(h) BRIEF SUMMARY OF THE INVENTION

An embodiment of the disclosure meets the needs presented above by generally comprising a plurality of scrubbing plates that each has a pair of engaging rods integrated into the scrubbing plates. A plurality of scrubbers is provided and a respective one of the scrubbers is attached to a respective one of the scrubbing plates to scrub a user's body. A handle plate includes a pair of engagement channels which releasably engages a respective one of the engagement rods on a respective scrubbing plate for releasably attaching the respective scrubbing plate to the handle plate. A handle is disposed on the handle plate to facilitate the user to employ the scrubber that is attached to the scrubber plate for scrubbing the user's body.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

(i) BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

(j) DETAILED DESCRIPTION OF THE INVENTION

Figure 1:
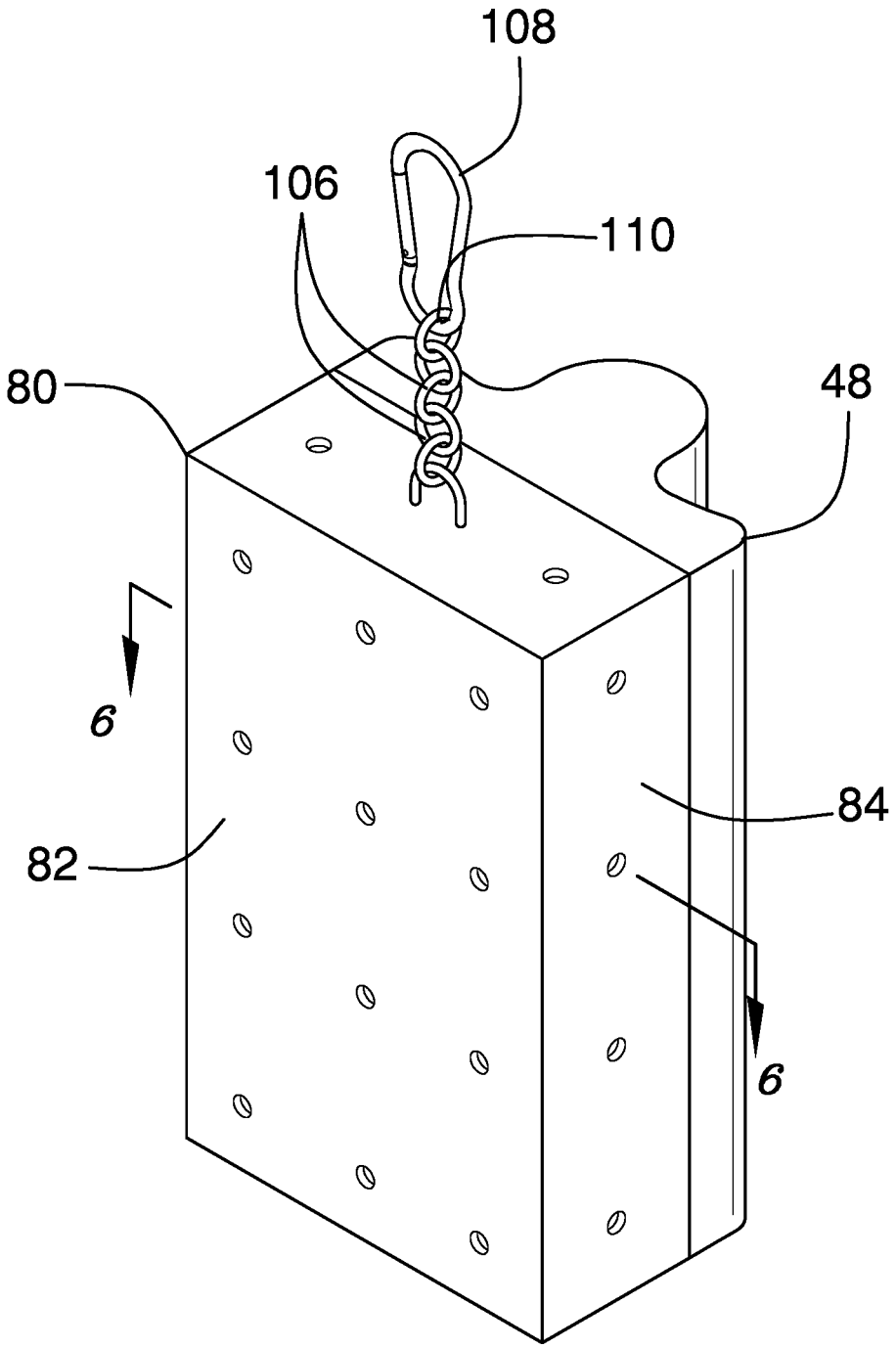
FIG. 1 is a front perspective view of a portable scrubbing assembly according to an embodiment of the disclosure.
Figure 2:
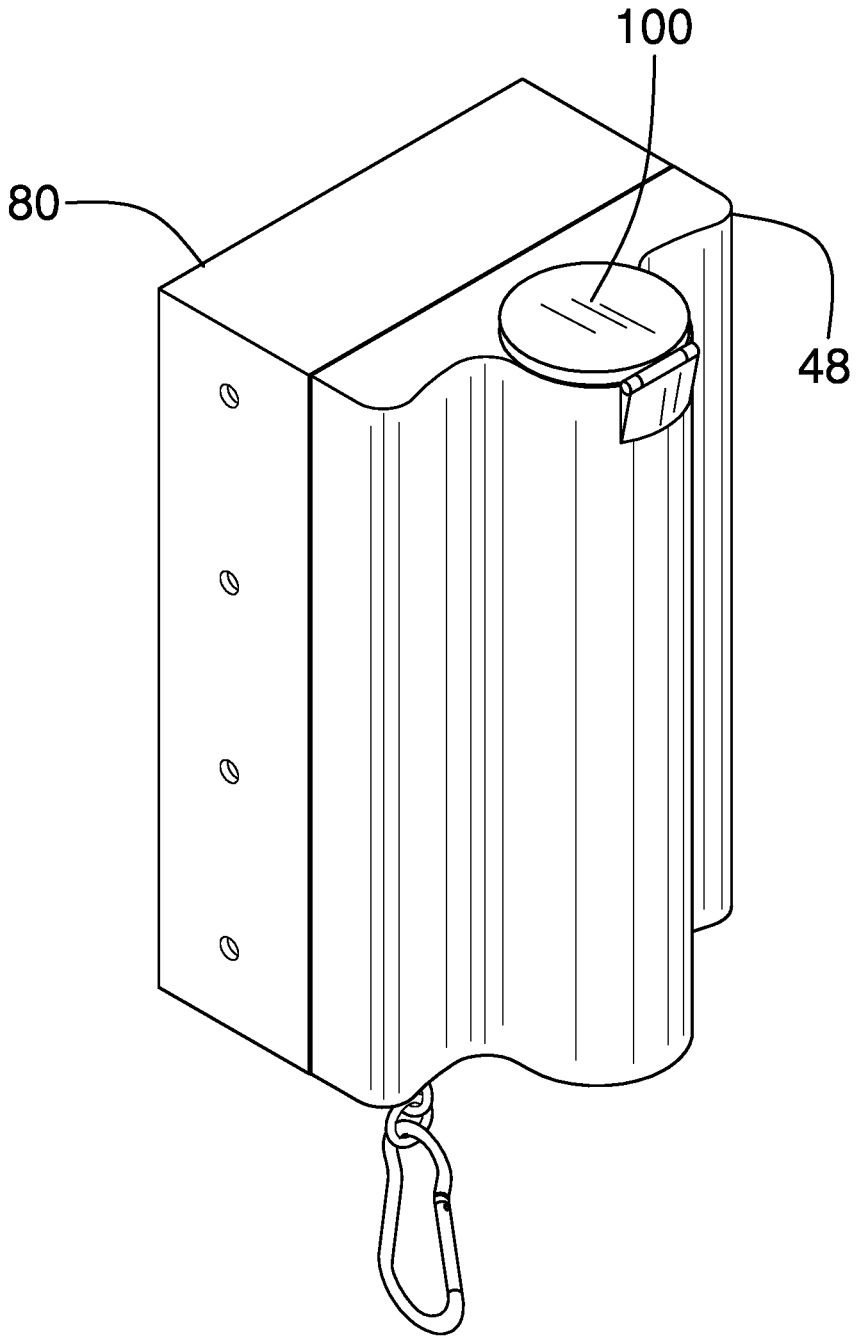
FIG. 2 is a back perspective view of an embodiment of the disclosure.
Figure 3:
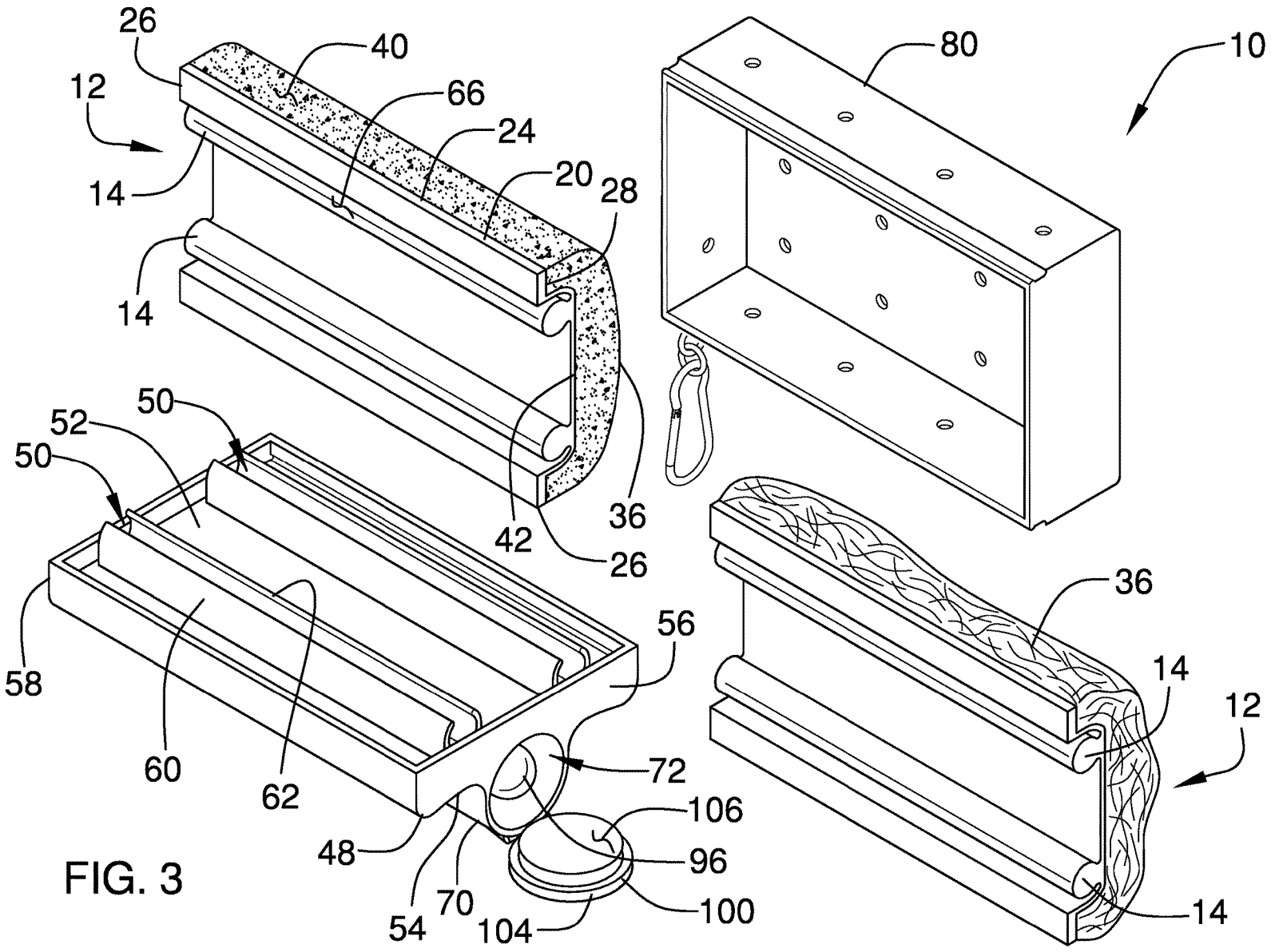
FIG. 3 is an exploded perspective view of an embodiment of the disclosure.
Figure 4:
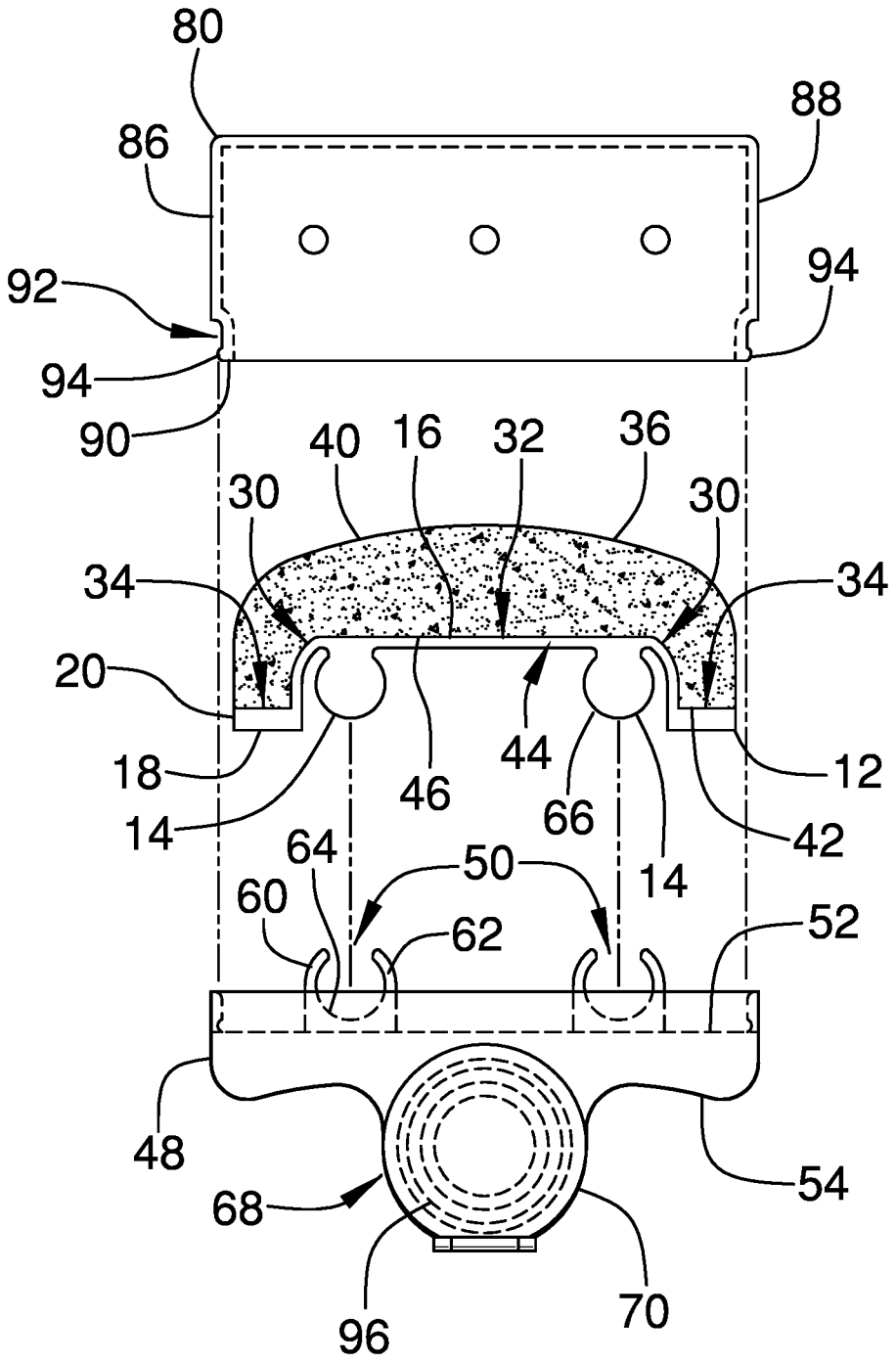
FIG. 4 is an exploded phantom view of an embodiment of the disclosure.
Figure 5:
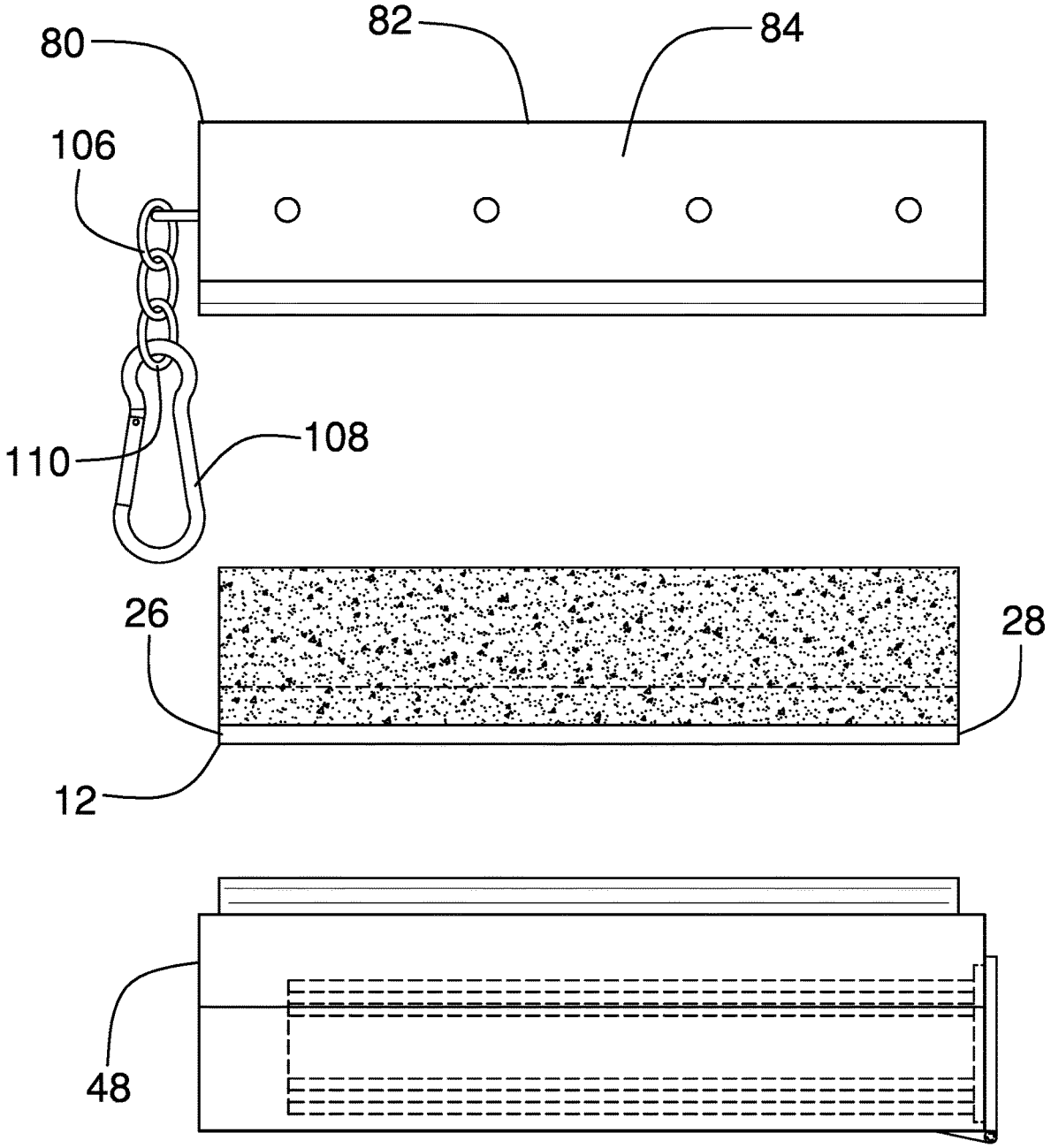
FIG. 5 is an exploded left side view of an embodiment of the disclosure.
Figure 6:
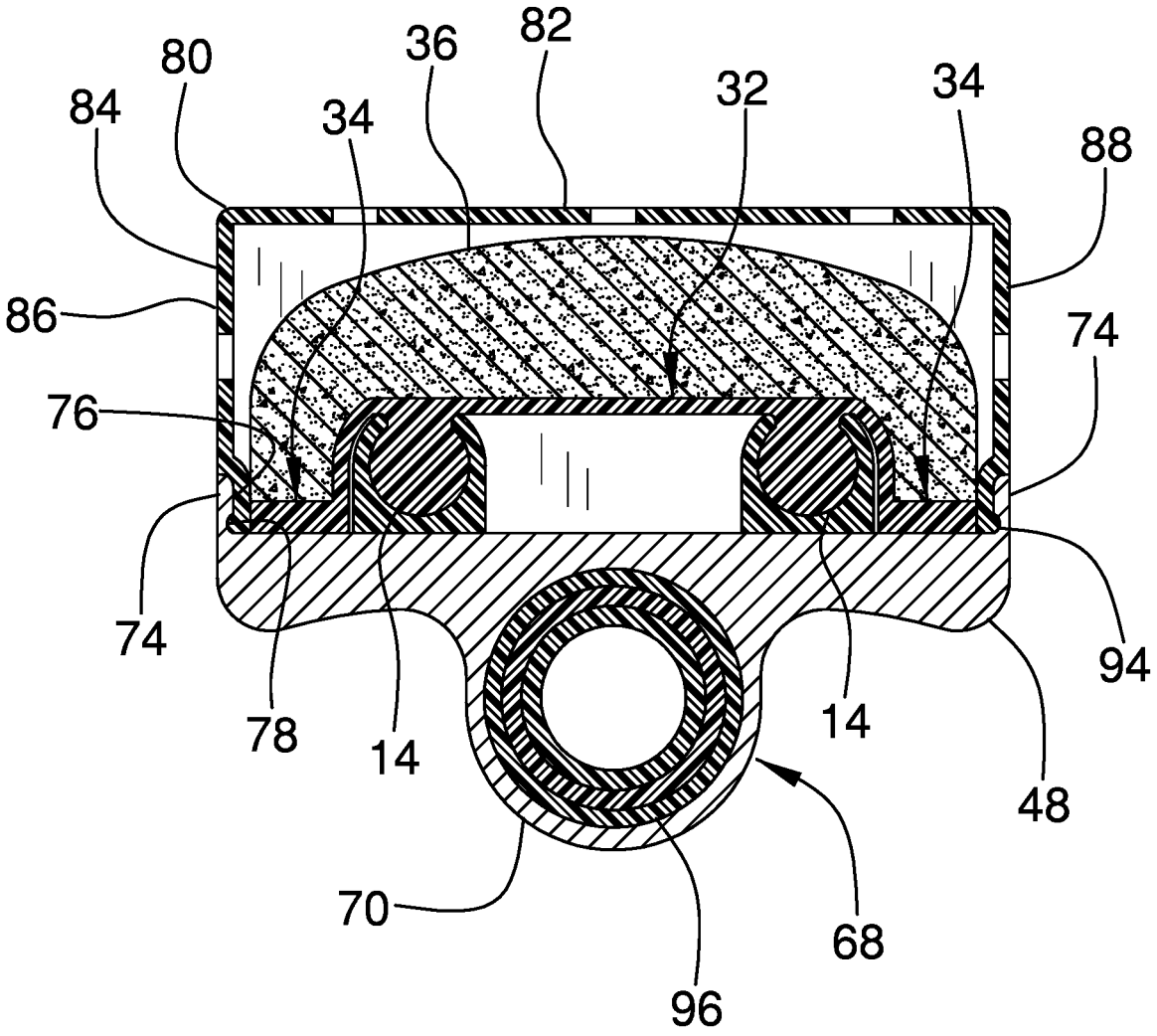
FIG. 6 is a cross sectional view taken along line 6-6 of FIG. 1 of an embodiment of the disclosure.
Figure 7:
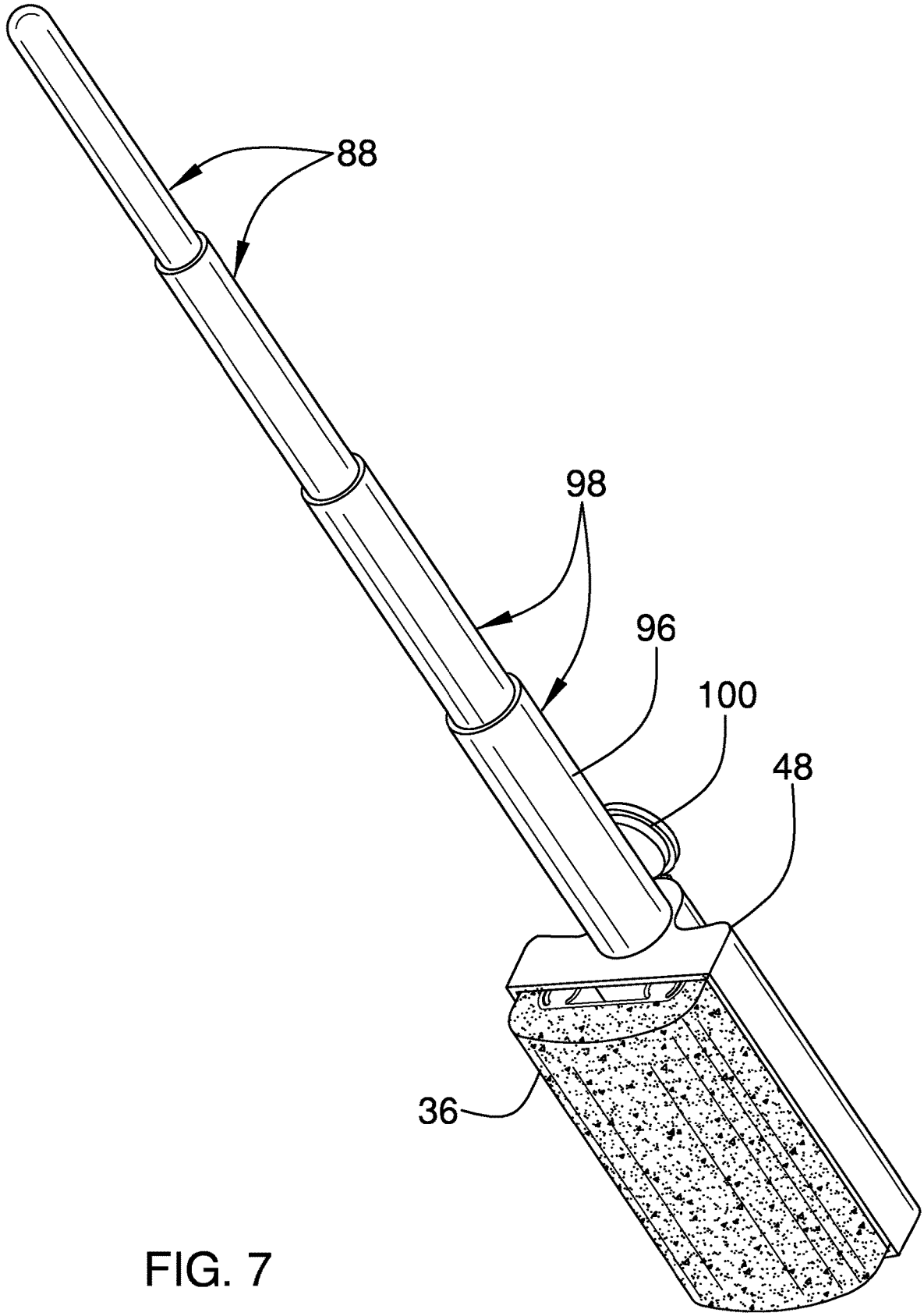
FIG. 7 is a perspective view of an embodiment of the disclosure showing a handle being extended from a handle plate.
Figure 8:
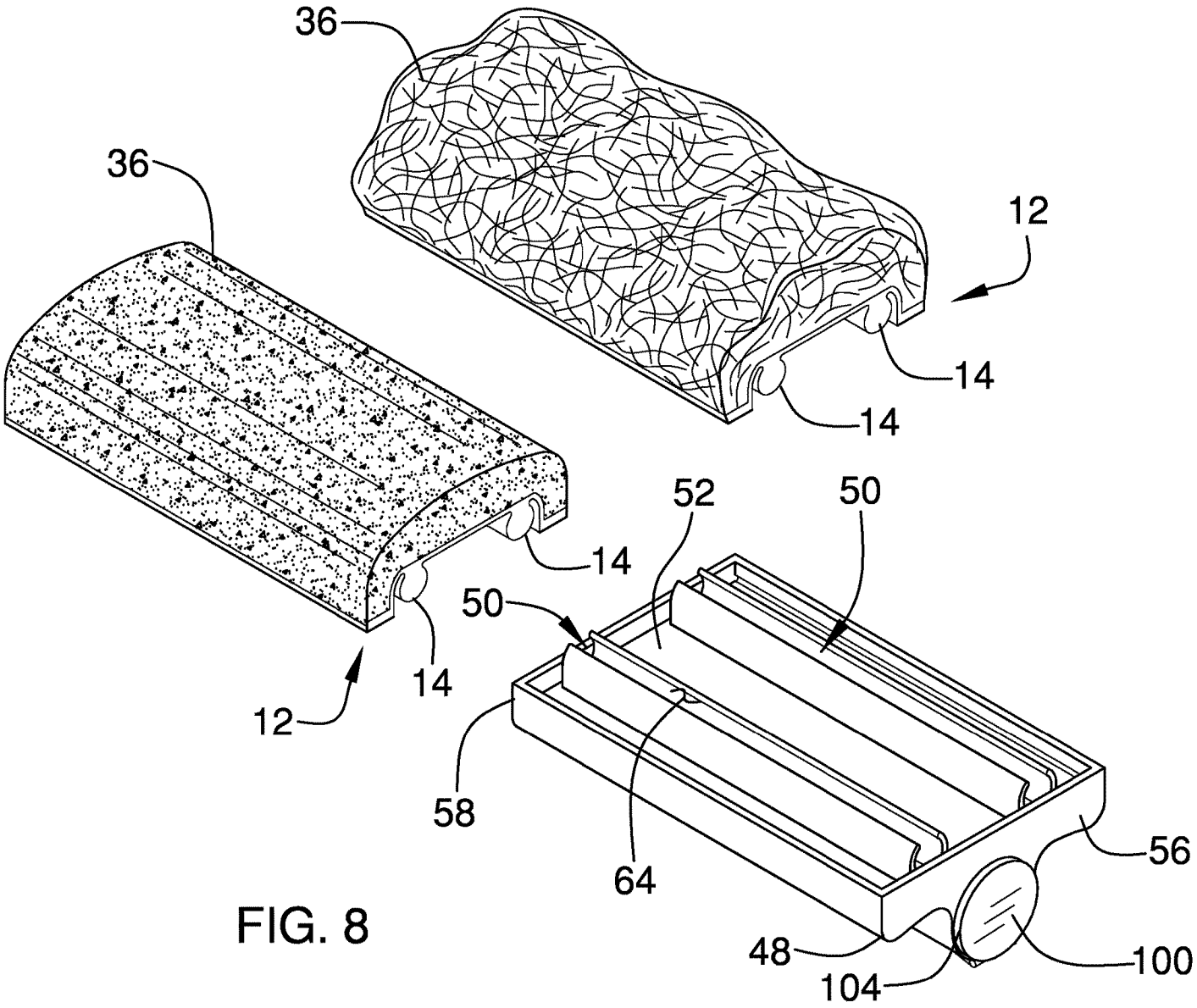
FIG. 8 is a perspective view of an embodiment of the disclosure showing a plurality of scrubber plates and a plurality of scrubbers.
Figure 9:
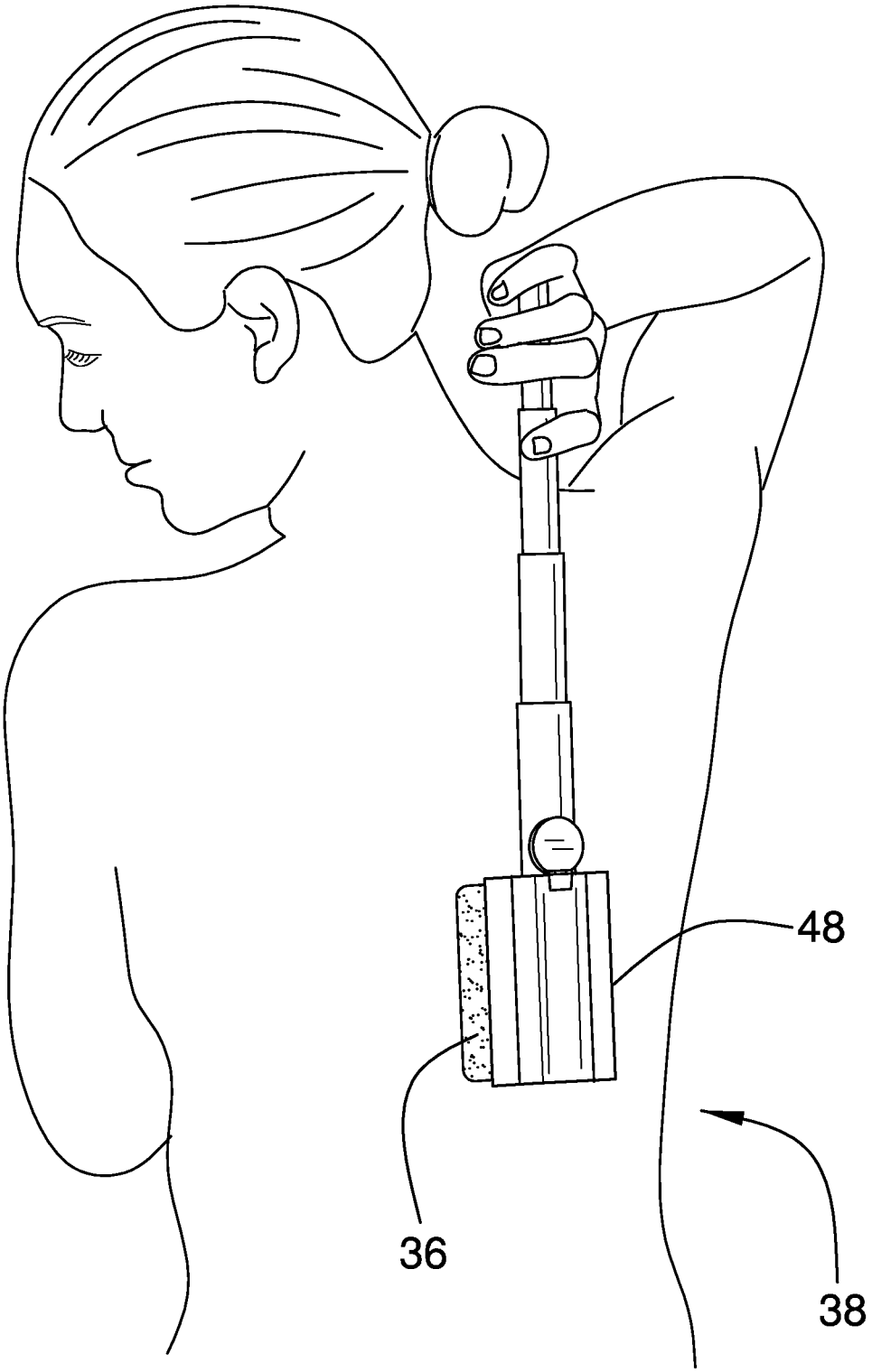
FIG. 9 is a perspective in-use view of an embodiment of the disclosure.

With reference now to the drawings, and in particular to FIGS. 1 through 9 thereof, a new scrubbing device embodying the principles and concepts of an embodiment of the disclosure and generally designated by the reference numeral 10 will be described.

As best illustrated in FIGS. 1 through 9, the portable scrubbing assembly 10 generally comprises a plurality of scrubbing plates 12 which each has a pair of engaging rods 14 each being integrated into a respective scrubbing plate 12. Each of the scrubbing plates 12 has a top surface 16, a bottom surface 18 and a perimeter edge 20 extending between the top surface 16 and the bottom surface 18, and the perimeter edge 20 has a first lateral side 22, a second lateral side 24, a front side 26 and a back side 28. Each of the scrubbing plates 12 has a pair of curved portions 30 each curving downwardly to define a central portion 32 and a pair of outward portions 34 each being spaced downwardly from the central portion 32. The top surface 16 corresponding to each of the outward portions 34 lies on a plane that is oriented parallel to top surface 16 corresponding to the central portion 32. Each of the outward portions 34 is coextensive with a respective one of the first lateral side 22 and the second lateral side 24 of the perimeter edge 20. Each of the engaging rods 14 is integrated into the bottom surface 18 and each of the engaging rods 14 extends between the front side 26 and the back side 28 of the perimeter edge 20. Furthermore, each of the engaging rods 14 is positioned adjacent to a respective one of the outward portions 34 of the respective scrubbing plate 12.

A plurality of scrubbers 36 is provided and a respective one of the scrubbers 36 is attached to a respective one of the scrubbing plates 12 to scrub a user's body 38. Each of the scrubbers 36 has an upper surface 40 and a lower surface 42, and the lower surface 42 of each of the scrubbers 36 has a recess 44 extending toward the upper surface 40. The recess 44 in the lower surface 42 of each of the scrubbers 36 extends along a full length of the scrubbers 36. The recess 44 has a bounding surface 46 and the bounding surface 46 of the respective scrubber 36 engages the top surface 16 corresponding to the central portion 32 of the respective scrubbing plate 12. Additionally, the lower surface 42 on either side of the recess 44 engages the top surface 16 corresponding to a respective one of the outward portions 34 of the respective scrubbing plate 12. The upper surface 40 of each of the scrubbers 36 is convexly arcuate with respect to the lower surface 42 such that the upper surface 40 intersects the lower surface 42 at a right angle along either side of the recess 44. The plurality of scrubbers 36 may include a loofah, a sponge and any other type of scrubber that is commonly employed to scrub human skin.

A handle plate 48 is provided which has a pair of engagement channels 50 that is each integrated into the handle plate 48. Each of the engagement channels 50 releasably engages a respective one of the engaging rods 14 on the respective scrubbing plate 12 for releasably attaching the respective scrubbing plate 12 to the handle plate 48. The handle plate 48 has a top side 52, a bottom side 54, a first end 56 and a second end 58, and the handle plate 48 is elongated between the first end 56 and the second end 58. Each of the engagement channels 50 extends away from the top side 52 and each of the engagement channels 50 is spaced apart from each other and extends between the first end 56 and the second end 58.

Each of the engagement channels 50 has a first side 60, a second side 62 and an engaging surface 64 extending between the first side 60 and the second side 62. The engaging surface 64 is concavely arcuate between the first side 60 and the second side 62. Furthermore, an outside surface 66 of each of the engaging rods 14 of the respective scrubbing plate 12 conforms to the engaging surface 64 of a respective one of the engagement channels 50 when the respective scrubbing plate 12 is attached to the handle plate 48. The bottom side 54 of the handle plate 48 has a curved section 68 forming a lobe 70 on the bottom side 54 which extends between the first end 56 and the second end 58 of the handle plate 48. The lobe 70 has an opening 72 extending into an interior of the lobe 70 and the opening 72 is aligned with the first end 56 of the handle plate 48.

The handle plate 48 has a pair of lips 74 each extending away from the top side 52. Each of the lips 74 extends between the first end 56 and the second end 58 of the handle plate 48 and each of the lips 74 is positioned on opposite sides of the handle plate 48 with respect to each other. Each of the lips 74 has a first surface 76 is directed toward a respective one of the engagement channels 50. Furthermore, the first surface 76 of each of the lips 74 has a slot 78 extending along a full length of the lip 74.

A cover 80 is removably attachable to the handle plate 48 for covering the respective scrubber 36 that is attached to the handle plate 48. The cover 80 is foraminous to pass air through the cover 80 to facilitate the respective scrubber 36 to dry when the cover 80 is positioned over the respective scrubber 36. The cover 80 has a top wall 82 and an outer wall 84 extending downwardly from the top wall 82, and the outer wall 84 has a first lateral side 86 and a second lateral side 88. Each of the first lateral side 86 and the second lateral side 88 of the outer wall 84 has a distal edge 90 with respect to the top wall 82.

Each of the first lateral side 86 and the second lateral side 88 of the outer wall 84 has an inset portion 92 is positioned adjacent to the distal edge. Each of the first lateral side 86 and the second lateral side 88 of the outer wall 84 has a lobe 94 extending outwardly therefrom. The inset portion 92 of each of the first lateral side 22 and the second lateral side 24 of the outer wall 84 receives a respective one of the lips 74 on the top side 52 of the handle plate 48 when the cover 80 is positioned on the handle plate 48. Furthermore, the lobe 94 on the each of the first lateral side 86 and the second lateral side 88 of the outer wall 84 engages the slot 78 in a respective one of the lips 74 for retaining the cover 80 on the handle plate 48.

A handle 96 is disposed on the handle plate 48 and the handle 96 is positionable in an extended position for gripping by the user. In this way the user can employ the scrubber 36 that is attached to the scrubbing plate 12 for scrubbing the user's body 38. The handle 96 is positionable in a stored position having the handle 96 being retracted into the handle plate 48. The handle 96 comprises a plurality of sections 98 that each slidably engages each other such that the handle 96 has a telescopically adjustable length. The handle 96 is collapsed within the lobe 70 on the bottom side 54 of the handle plate 48 when the handle 96 is positioned on the stored position. Conversely, the handle 96 extends outwardly from the opening 72 in the lobe 70 when the handle 96 is positioned in the extended position.

A cap 100 is provided that has a primary surface 102 and an outer edge 104. The outer edge 104 is hingedly coupled to the first end 56 of the handle plate 48. The cap 100 is positionable in a closed position has the primary surface 102 of the cap 100 covering the opening 72 in the lobe 70. Conversely, the cap 100 is positionable in an open position having the cap 100 exposing the opening 72 in the lobe 70. A chain 106 is attached to the outer wall 84 of the cover 80 and a clip 108 is attached to a free end 110 of the chain 106. The clip 108 can be engaged to a support for suspending the cover 80, and subsequently the handle plate 48 when the cover 80 is attached to the cover 80, for storage. The clip 108 may comprise a D-ring, a lobster claw or other type of releasable clip.

In use, the scrubbing plate 12 associated with a desired scrubber 36 is attached to the handle plate 48 and the handle 96 is extended into the deployed position. In this way the user can employ the desired scrubber 36 to scrub their body 38 while showering or bathing. The cover 80 is placed on the scrubbing plate 12 when the scrubber 36 is not being employed. Additionally, the scrubbing plates 12 can be interchanged on the handle plate 48 at any time. The clip 108 can be attached to a support for storing the cover 80 and the scrubbing plate 12.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A portable scrubbing assembly for facilitating a user to scrub their body, said assembly comprising:

a plurality of scrubbing plates, each of said scrubbing plates having a pair of engaging rods each being integrated into said scrubbing plates;

a plurality of scrubbers, a respective one of said scrubbers being attached to a respective one of said scrubbing plates wherein said respective scrubber is configured to scrub a user's body;

a handle plate having a pair of engagement channels each being integrated into said handle plate, each of said engagement channels releasably engaging a respective one of said engagement rods on a respective scrubbing plate for releasably attaching said respective scrubbing plate to said handle plate;

a cover being removably attachable to said handle plate for covering said respective scrubber that is attached to said handle plate, said cover being foraminous wherein said cover is configured to pass air through said cover to facilitate said respective scrubber to dry when said cover is positioned over said respective scrubber;

a handle being disposed on said handle plate, said handle being positionable in an extended position wherein said handle is configured to be gripped by a user to facilitate the user to employ said scrubber that is attached to said scrubber plate for scrubbing the user's body, said handle being positionable in a stored position having said handle being retracted into said handle plate;

wherein each of said scrubbing plates has a top surface, a bottom surface and a perimeter edge extending between said top surface and said bottom surface, said perimeter edge having a first lateral side, a second lateral side, a front side and a back side, each of said scrubbing plates having a pair of curved portions each curving downwardly to define a central portion and a pair of outward portions each being spaced downwardly from said central portion, said top surface corresponding to each of said outward portions lying on a plane being oriented parallel to top surface corresponding to said central portion, each of said outward portions being coextensive with a respective one of said first lateral side and said second lateral side of said perimeter edge; and wherein each of said engaging rods is integrated into said bottom surface, each of said engaging rods extending between said front side and said back side of said perimeter edge, each of said engaging rods being positioned adjacent to a respective one of said outward portions of said respective scrubbing plate.

2. The assembly according to claim 1, wherein;

each of said scrubbers has an upper surface and a lower surface, said lower surface of each of said scrubbers having a recess extending toward said upper surface, said recess in said lower surface of each of said scrubbers extending along a full length of said scrubbers, said recess having a bounding surface, said bounding surface of said respective scrubber engaging said top surface corresponding to said central portion of said respective scrubbing plate having said lower surface on either side of said recess engaging said top surface corresponding to a respective one of said outward portions of said respective scrubbing plate; and said upper surface of each of said scrubbers is convexly arcuate with respect to said lower surface such that said upper surface intersects said lower surface at a right angle along either side of said recess.

3. The assembly according to claim 1, wherein said handle plate has a top side, a bottom side, a first end and a second end, said handle plate being elongated between said first end and said second end, each of said engagement channels extending away from said top side, each of said engagement channels being spaced apart from each other and extending between said first end and said second end, each of said engagement channels having a first side, a second side and an engaging surface extending between said first side and said second side, said engaging surface being concavely arcuate between said first side and said second side, an outside surface of each of said engaging rods of a respective one of said scrubbing plates conforming to said engaging surface of a respective one of said engagement channels when said respective scrubbing plate is attached to said handle plate.

4. The assembly according to claim 3, wherein said bottom side of said handle plate has a curved section forming a lobe on said bottom side which extends between said first end and said second end of said handle plate, said lobe having an opening extending into an interior of said lobe, said opening being aligned with said first end of said handle plate.

5. The assembly according to claim 4, wherein said handle comprises a plurality of sections each slidably engaging each other such that said handle has a telescopically adjustable length, said handle being collapsed within said lobe on said bottom side of said handle plate when said handle is positioned on said stored position, said handle extending outwardly from said opening in said lobe when said handle is positioned in said extended position.

6. The assembly according to claim 4, further comprising a cap being hingedly coupled to said first end of said handle plate, said cap being positionable in a closed position having said cap covering said opening in said lobe, said cap being positionable in an open position having said cap exposing said opening in said lobe.

7. The assembly according to claim 3, wherein said handle plate has a pair of lips each extending away from said top side, each of said lips extending between said first end and said second end of said handle plate, each of said lips being positioned on opposite sides of said handle plate with respect to each other, each of said lips having a first surface being directed toward a respective one of said engagement channels, said first surface of each of said lips having a slot extending along a full length of said lip.

8. The assembly according to claim 7, wherein:

said cover has a top wall and an outer wall extending downwardly from said top wall, said outer wall having a first lateral side and a second lateral side, each of said first lateral side and said second lateral side of said outer wall having a distal edge with respect to said top wall, each of said first lateral side and said second lateral side of said outer wall having an inset portion being positioned adjacent to said distal edge; and each of said first lateral side and said second lateral side of said outer wall has a lobe extending outwardly therefrom, said inset portion of each of said first lateral side and said second lateral side of said outer wall receiving a respective one of said lips on said top side of said handle plate when said cover is positioned on said handle plate, said lobe on said each of said first lateral side and said second lateral side of said outer wall engaging said slot in a respective one of said lips for retaining said cover on said handle plate.

9. A portable scrubbing assembly for facilitating a user to scrub their body, said assembly comprising:

a scrubbing plate having a pair of engaging rods each being integrated into said scrubbing plate, each of said scrubbing plates has a top surface, a bottom surface and a perimeter edge extending between said top surface and said bottom surface, said perimeter edge having a first lateral side, a second lateral side, a front side and a back side, each of said scrubbing plates having a pair of curved portions each curving downwardly to define a central portion and a pair of outward portions each being spaced downwardly from said central portion, said top surface corresponding to each of said outward portions lying on a plane being oriented parallel to top surface corresponding to said central portion, each of said outward portions being coextensive with a respective one of said first lateral side and said second lateral side of said perimeter edge, each of said engaging rods is integrated into said bottom surface, each of said engaging rods extending between said front side and said back side of said perimeter edge, each of said engaging rods being positioned adjacent to a respective one of said outward portions of said respective scrubbing plate;

a plurality of scrubbers, a respective one of said scrubbers being attached to a respective scrubbing plate wherein said respective scrubber is configured to scrub a user's body, each of said scrubbers having an upper surface and a lower surface, said lower surface of each of said scrubbers having a recess extending toward said upper surface, said recess in said lower surface of each of said scrubbers extending along a full length of said scrubbers, said recess having a bounding surface, said bounding surface of said respective scrubber engaging said top surface corresponding to said central portion of said respective scrubbing plate having said lower surface on either side of said recess engaging said top surface corresponding to a respective one of said outward portions of said respective scrubbing plate, said upper surface of each of said scrubbers being convexly arcuate with respect to said lower surface such that said upper surface intersects said lower surface at a right angle along either side of said recess;

a handle plate having a pair of engagement channels each being integrated into said handle plate, each of said engagement channels releasably engaging a respective one of said engagement rods on a respective scrubbing plate for releasably attaching said respective scrubbing plate to said handle plate, said handle plate having a top side, a bottom side, a first end and a second end, said handle plate being elongated between said first end and said second end, each of said engagement channels extending away from said top side, each of said engagement channels being spaced apart from each other and extending between said first end and said second end, each of said engagement channels having a first side, a second side and an engaging surface extending between said first side and said second side, said engaging surface being concavely arcuate between said first side and said second side, an outside surface of each of said engaging rods of said respective scrubbing plate conforming to said engaging surface of a respective one of said engagement channels when said respective scrubbing plate is attached to said handle plate, said bottom side of said handle plate having a curved section forming a lobe on said bottom side which extends between said first end and said second end of said handle plate, said lobe having an opening extending into an interior of said lobe, said opening being aligned with said first end of said handle plate, said handle plate having a pair of lips each extending away from said top side, each of said lips extending between said first end and said second end of said handle plate, each of said lips being positioned on opposite sides of said handle plate with respect to each other, each of said lips having a first surface being directed toward a respective one of said engagement channels, said first surface of each of said lips having a slot extending along a full length of said lip;

a cover being removably attachable to said handle plate for covering said respective scrubber that is attached to said handle plate, said cover being foraminous wherein said cover is configured to pass air through said cover to facilitate said respective scrubber to dry when said cover is positioned over said respective scrubber, said cover having a top wall and an outer wall extending downwardly from said top wall, said outer wall having a first lateral side and a second lateral side, each of said first lateral side and said second lateral side of said outer wall having a distal edge with respect to said top wall, each of said first lateral side and said second lateral side of said outer wall having an inset portion being positioned adjacent to said distal edge, each of said first lateral side and said second lateral side of said outer wall having a lobe extending outwardly therefrom, said inset portion of each of said first lateral side and said second lateral side of said outer wall receiving a respective one of said lips on said top side of said handle plate when said cover is positioned on said handle plate, said lobe on said each of said first lateral side and said second lateral side of said outer wall engaging said slot in a respective one of said lips for retaining said cover on said handle plate;

a handle being disposed on said handle plate, said handle being positionable in an extended position wherein said handle is configured to be gripped by a user to facilitate the user to employ said scrubber that is attached to said scrubber plate for scrubbing the user's body, said handle being positionable in a stored position having said handle being retracted into said handle plate, said handle comprising a plurality of sections each slidably engaging each other such that said handle has a telescopically adjustable length, said handle being collapsed within said lobe on said bottom side of said handle plate when said handle is positioned on said stored position, said handle extending outwardly from said opening in said lobe when said handle is positioned in said extended position; and a cap being hingedly coupled to said first end of said handle plate, said cap being positionable in a closed position having said cap covering said opening in said lobe, said cap being positionable in an open position having said cap exposing said opening in said lobe.

* * * * *